US005165489A

United States Patent [19]

Langston

[11] Patent Number: 5,165,489

[45] Date of Patent: Nov. 24, 1992

[54] SAFETY DEVICE TO PREVENT PREMATURE FIRING OF EXPLOSIVE WELL TOOLS

[76] Inventor: Thomas J. Langston, 503 Caliente St., New Iberia, La. 70560

[21] Appl. No.: 838,035

[22] Filed: Feb. 20, 1992

[51] Int. Cl.[5] ..... E21B 43/112

[52] U.S. Cl. ..... 175/4.54; 166/55.1

[58] Field of Search ..... 166/55, 55.1, 297; 175/4.54, 4.56, 4.52

[56] References Cited

U.S. PATENT DOCUMENTS

| | | | |
|---|---|---|---|
| 4,266,613 | 5/1981 | Boop | 166/299 |
| 4,306,628 | 12/1981 | Adams, Jr. et al. | 175/4.56 |
| 4,314,614 | 2/1982 | McPhee et al. | 166/55.1 X |
| 4,560,000 | 12/1985 | Upchurch | 166/55.1 |
| 4,648,470 | 3/1987 | Gambertoglio | 175/4.54 |
| 4,817,718 | 4/1989 | Nelson et al. | 166/297 |
| 4,901,802 | 2/1990 | George et al. | 175/4.52 |
| 4,924,952 | 5/1990 | Schneider | 175/4.54 |
| 4,967,048 | 10/1990 | Langston | 166/55.1 X |
| 4,969,525 | 11/1990 | George et al. | 175/4.54 X |

*Primary Examiner*—Ramon S. Britts
*Assistant Examiner*—Frank S. Tsay
*Attorney, Agent, or Firm*—Dodge, Bush, Moseley & Riddle

[57] ABSTRACT

In accordance with illustrative embodiments of the present invention, a hydrostatic pressure-responsive safety sub that prevents firing of an explosive well tool until it has been lowered below a predetermined depth in a fluid-filled well bore includes a body having an upper chamber that houses a detonator and a lower chamber that houses a booster which is attached to a primercord. A passageway between these chambers normally is blocked by an inner portion of a spring-loaded, hydrostatic pressure-responsive piston which is shifted inward against the bias of a combination of springs. When the explosive tool has been lowered to a predetermined depth in the well, a bore in the piston becomes aligned with the passageway between the chambers so that explosive forces generated by explosion of the detonator can reach the booster.

16 Claims, 1 Drawing Sheet

FIG. 1
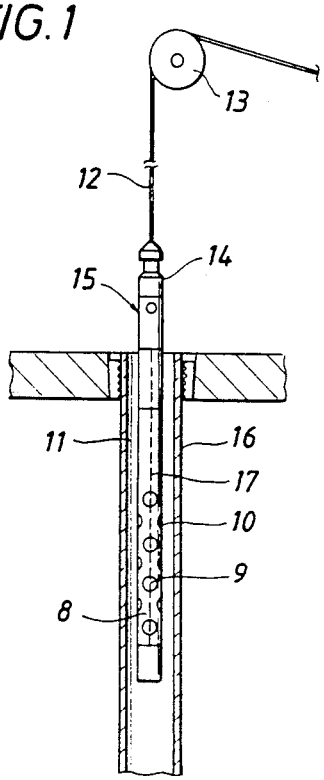
FIG. 2
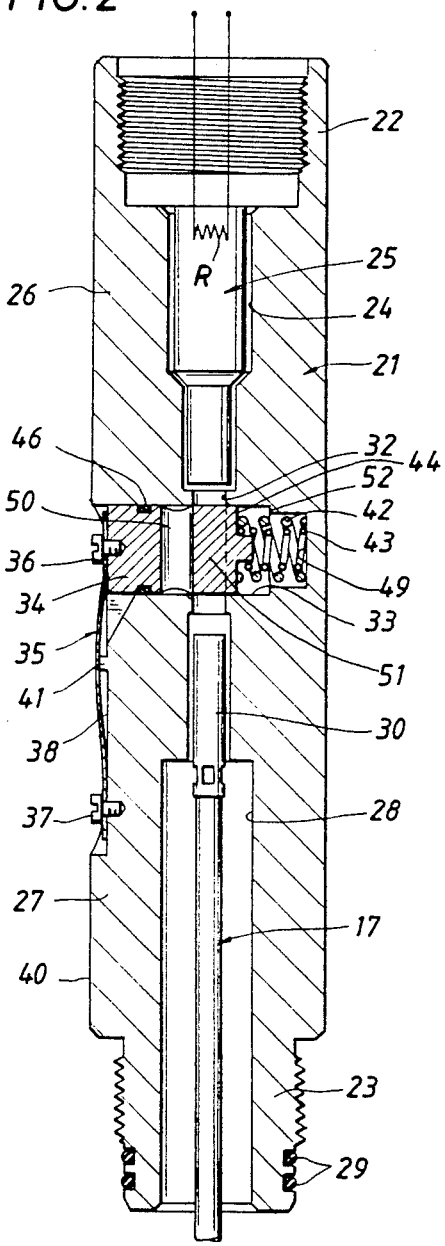
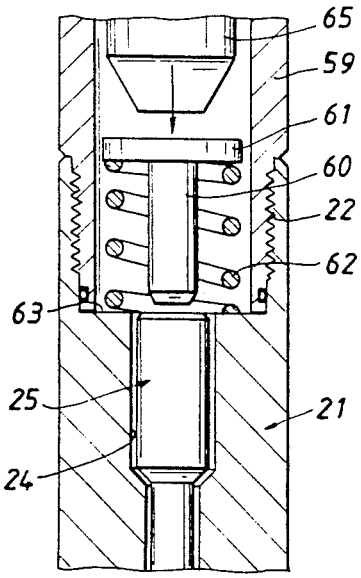
FIG. 4
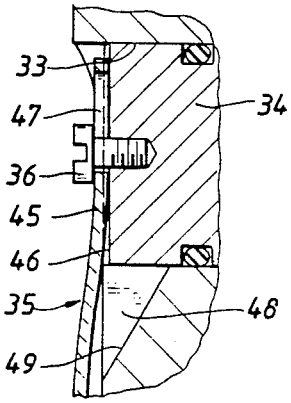
FIG. 3

SAFETY DEVICE TO PREVENT PREMATURE FIRING OF EXPLOSIVE WELL TOOLS

FIELD OF THE INVENTION

This invention relates generally to a safety device that prevents premature or accidental firing of an explosive well tool, and particularly to a new and improved pressure-responsive safety device that blocks the firing of the explosive well tool unless it is submerged below a certain depth in a fluid-filled well bore.

BACKGROUND OF THE INVENTION

There have been numerous accidents resulting in severe injury or death where an explosive well tool such as a perforating gun fires prematurely at the surface while a crew was rigging the tool up in preparation for running it into the well. Various causes for such premature firing are set forth in the introductory portion of my U.S. Pat. No. 4,967,048, issued Oct. 30, 1990 which is incorporated herein by reference. The devices disclosed and claimed in the above-mentioned patent provide selectively operable ground connections that prevent sufficient electric current from flowing to the detonator to set it off until the ground connection is broken at the surface immediately before the tool is run into the well. Another approach to this problem is disclosed and claimed in my U.S. application Ser. No. 779,650 filed Oct. 21, 1991 which involves a ground connection that automatically is broken when the explosive tool has been lowered to a predetermined depth in the well. Still another approach is to provide a type of mechanical "safety" that prevents the tool from firing, even though an electrical signal of a sufficiently high current level is applied to the cable to set off the detonator, until the safety is released in some manner.

Various mechanical safety devices have been proposed, but to applicant's knowledge none have been particularly successful. For example, U.S. Pat. No. 4,523.650 discloses a rotatable plug that prevents firing until the plug has been turned by hand at the surface. U.S. Pat. No. 4,314,614 shows an interrupter or block that is attached to a lanyard which is pulled to remove the block prior to running the tool into the well. However, these devices arm the perforating gun while it is just below the rig floor, and if the gun prematurely fires at this location after these devices have been manipulated, well head equipment such as blow out preventers and the like will be perforated and rendered inoperable. Serious injuries still can occur, not to mention the delay, trouble and expense of replacing damaged equipment.

Another U.S. Pat. No. 4,266,613 shows a hydrostatic pressure operated electrical connector having a pin and a mating socket that are spaced apart until the tool reaches a certain depth in the well. However this device involves sequentially operated hot wire and ground switches, and is quite complicated and expensive to manufacture. Moreover the tool requires a large number of O-rings and other seals, which increases the likelihood of leakage and other operational problems that will cause improper operation.

An object of the present invention is to provide a new and improved hydro-mechanical safety device for a explosive well tool that obviates the above-mentioned problems.

Another object of the present invention is to provide a new and improved hydromechanical safety device of the type described which will not permit the explosive well tool to be fired unless it is below a predetermined depth in the well.

SUMMARY OF THE INVENTION

These and other objects are attained in accordance with the concepts of the present invention through the provision of a safety apparatus comprising a tubular body having longitudinally spaced upper and lower chambers whose adjacent ends are communicated by a passage. The upper chamber houses a detonator which can be fired on command from the surface, and the lower chamber houses a booster that is exploded in response to firing of the detonator. The booster is attached to the upper end of a length of primercord that extends downward to explosive charges. A hydrostatic pressure-responsive piston is movable in a transverse bore in the body that intersects the passage between the chambers from a first, outer position where a section thereof bridges the passage to block it off, and a second, inner position where a bore in the piston is aligned with the passage to communicate the upper and lower chambers. A system of springs provides a selected resistance to inward movement of the piston which must be overbalanced by a predetermined level of hydrostatic pressure forces acting on the piston before it can move completely inward to the second position. Unless the piston is substantially lined up with the body passage, explosive forces generated when the detonator is fired cannot reach the booster and cause it and the primercord to explode. Thus the piston positively prevents firing of the explosive well tool unless it is submerged below a predetermined depth in a fluid-filled well bore.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a schematic view of a explosive well tool such as a perforating gun being lowered into a well bore;

FIG. 2 is a longitudinal sectional view of one embodiment of the present invention; and FIG. 3 is an enlarged fragmentary view of the piston and its connection to a leaf spring; and;

FIG. 4 is a longitudinal sectional view showing how the safety device of the present invention and a perforating gun can be run on tubing.

DETAILED DESCRIPTION OF A PREFERRED EMBODIMENT

Referring initially to FIG. 1, an explosive tool 10 such as a perforating gun which carries plurality of shaped charges 9 mounted around and along a barrel 8 is shown being lowered into a well bore 11 on an electric wire line 12. The wire line 12 goes up over a sheave 13 and then outward to the winch of a service truck (not shown). The outer end of the cable 12 is attached by a cable head 14 to a safety sub assembly 15 that is constructed in accordance with the present invention. The sub 15 is connected to the uppermost end of the tool 10, and operates to prevent the tool from being fired unless it is submerged below a certain depth in the well 11. In a typical application, the cable 12 is a monocable that has a single insulated conductor wire inside a core that has metal armor wires layed around it to provide strength. The well bore 11 usually is lined with a casing 16, and the explosive tool 10 will be operated to form perforations through the walls of the casing and into the formations over a depth interval where oil or gas production is expected. Of course, the present invention can be use in numerous other applications that involve explosive tools, such as casing or tubing cutters, string shots and the like. Each of these explosive tools typically includes a detonator fuse that fires when a certain level of electric current is applied to it via the cable 12, a booster that explodes in response to firing of the detonator, and a primercord that explodes when the booster explodes. The primercord is shown generally by a dash line 17 in FIG. 1, and is connected to rear ends of the various shaped-charges 8.

Referring now to FIG. 2, the safety assembly 15 includes a tubular body 21 having a threaded box 22 at its upper end by which the body is connected to the cable head 14, and a threaded pin 23 at its lower end by which it is connected to the explosive well tool 10. Both connections are sealed by means such as the O-rings 29 on the pin 23, so that well fluids cannot leak into the interior of the body 21. The upper section 26 of the body 21 has an internal generally cylindrical chamber 24 which receives a detonator 25 that can be fired in response to an electric signal from the cable 12 which is applied by one of the leads to a resistor R or the like. The other lead is grounded to the armor wires of the cable 12. The lower section 27 of the body 21 also has an internal cylindrical chamber 28 which houses a booster 30 that is crimped onto the upper end of the primercord 17. The adjacent ends of the chambers 24, 28 are communicated by an internal passage or bore 32 which is concentric therewith.

A radially or transversely extending bore 33 formed in the walls of the body 21 intersects the passage 32, and slidably receives a piston member 34. The outer face of the piston member 34 is attached to the upper end portion of a leaf spring 35 by a cap screw 36, and the lower end portion of the leaf spring is connected to the body 21 by another cap screw 37. The spring 35 preferably is positioned in a longitudinal recess 38 formed in the body 21 in a manner such that it and the cap screws 36, 37 do not protrude beyond the outer surface 40 of the body. An outwardly directed shoulder 41 can be provided to act as a fulcrum point for the bending of the upper portion of the leaf spring 35 as the piston member 34 shifts inward. A pair of nested coil springs 42, 43 react between a rear surface 44 of the piston member 34 and a shoulder 49 on the body 21 to yieldably resist inward movement of the piston member 34. The piston member 34 carries an O-ring seal 46 that prevents fluid leakage between it and the bore 33.

As shown in further detail in FIG. 3, the upper portion 45 of the leaf spring 35 is loosely received in a diametrical groove 46 in the outer face of the piston 34 to prevent rotation of the piston within the body bore 33. The cap screw 36 extends through an elongated slot 47 in the spring portion 45 so that the screw can move relatively upward in the slot as the piston member 34 moves inward, and vice versa. To accommodate inward bending movement of the spring portion 45, a longitudinal recess 48 having an inclined inner wall 49 is formed in the body 21 adjacent the bore 33 as shown.

As shown in FIG. 2, a central portion of the piston member 34 is provided with a cylindrical bore 50 whose axis is parallel to, or concentric with, the axis of the passage 32, depending upon the lateral position of the piston member 34 in the transverse bore 33. When the piston member 34 is in its outer position as shown in FIG. 2, the inner region 51 thereof adjacent the bore 50 substantially blocks communication through the passage 32 so that pressure forces due to explosion of the detonator 25 cannot reach the booster 30, at least with sufficient energy to set it off. However, when the piston member 34 is shifted inward enough against the combined influences of the springs 35, 42, and 43, the bore 50 is lined up with the passage 32 between the chambers 24 and 28, so that the explosive forces generated by the detonator 25 can reach the booster 30 and cause it and the primercord 31 to explode.

OPERATION

The parts of the safety sub assembly 15 are assembled as shown in the drawings, and the sub is connected between the cable head 14 and the perforating gun 10 by making up the threaded connectors 22 and 23. The springs 35, 42, and 43 maintain the piston member 34 in the outer position shown in FIG. 2 so that its inner region 51 blocks communication through the passage 32, so that even if the detonator 25 were to be accidentally or prematurely fired, the perforating gun 10 will not fire because the booster 30 cannot be fired. Thus the tool assembly can be safely handled and rigged up at the surface in preparation for running the gun into the well bore 11.

As the tools are lowered into the fluid-filled well bore 11, the piston member 34 experiences gradually increasing hydrostatic pressure forces and begins to shift inward. During such inward movement, the coil springs 42 and 43 are compressed, and the upper portion 45 of the leaf spring 35 resiles inward into the slot 47. As the piston member 34 shifts inward, the cap screw 36 advances relatively upward in the slot 47. The engagement of spring portion 45 with the groove 46 maintains the rotational orientation of the piston member 34. At a depth in the well where the hydrostatic pressure force is great enough, the piston member will have shifted inward enough to bring its passage 50 into alignment with the passage 32, at which point the shoulder 44 will engage a confronting shoulder 52 on the body 21 to stop further inward movement. Further lowering will not then result in any additional inward movement of the piston member 34.

The explosive well tool 10 now is armed because the explosive forces generated by explosion of the detonator 25 can reach the booster 30 via the bores 37 and 50 and cause the booster and primercord 31 to also explode. As the tools are being withdrawn from the well bore after firing, at about the same depth mentioned above, the hydrostatic pressure forces will become less than the combined bias forces of the springs 35, 42 and 43, and the piston member 34 will begin to shift outward to again position the blocking section 48 across the passage 32. Thus, if any shaped-charge in the tool 10 did not fire at depth, it cannot be accidentally fired at the surface as the tools are being rigged own.

FIG. 4 shows a modification in accordance with the present invention where the explosive well tool 10 is adapted to be run on tubing or drill pipe 59 in a process generally known as tubing-conveyed perforating. A firing pin 60 having a top plate 61 is held upward by a spring 62 that reacts between a transverse shoulder 63 and the lower face of the plate 61. The lower end of the firing pin 60 normally is spaced above the detonator 25 as shown. However, when impacted by a weight or "go-devil" 65 that is dropped down through the tubing 59, the pin 60 is driven downward to cause the detonator 25 to explode. The hydrostatic responsive piston member and bias spring arrangement for this embodiment is the same in structure and operation as the elements shown in FIGS. 2 and 3, so that the explosive well tool cannot be fired unless the assembly has been lowered beyond a predetermined depth in the well. This is true even if inertial forces or the like caused by banging the tool against a stop were to cause the firing pin 60 to engage the detonator 25 and cause its explosion.

It now will be recognized that a new and improve safety sub has been provided that meets all the objectives and has all the advantages and features of the present invention. Since certain changes or modifications may be made in the disclosed embodiments without departing from the inventive concepts involved, it is the aim of the appended claims to cover all such changes and modifications falling within the true spirit and scope of the present invention.

What is claimed is:

1. Apparatus for use in blocking the firing of an explosive well tool unless and until said well tool is positioned below a predetermined depth in a fluid-filled well bore, comprising: a tubular body having upper and lower chambers; first passage means between said chambers; one of said chambers having a first explosive means mounted therein and the other of said chambers having a second explosive means mounted therein that is adapted to be detonated by explosive forces generated by detonation of said first explosive means; hydrostatic pressure responsive piston means on said body having second passage means therethrough, said piston means being movable between a first position where a portion thereof blocks said first passage means and a second position where said second passage means is aligned with said first passage means to enable transmission of said explosive forces; and yieldable means resisting movement of said piston means toward said second position in a manner such that said first and second passage means are not aligned until said apparatus has been lowered to a predetermined depth in a well bore.

2. The apparatus of claim 1 where said yieldable means includes coil spring means reacting between said body and said piston means for biasing said piston means toward said first position.

3. The apparatus of claim 1 where said yieldable means includes a leaf spring having opposite end portions, one of said end portions being attached to said body and the other of said end portions being attached to said piston means.

4. The apparatus of claim 3 where said yieldable means includes at least one coil spring reacting between said body and said piston means.

5. The apparatus of claim 3 further including means providing a slidable connection between said other end portion and said piston means.

6. The apparatus of claim 5 further including recess means in said body to enable inward flexure of said other end portion as said piston means moves toward said second position.

7. The apparatus of claim 6 further including means on said body engaging a central portion of said leaf spring to provide a fulcrum point for said inward flexure.

8. The apparatus of claim 5 further including means for maintaining said piston means in a certain rotational orientation on said body.

9. The apparatus of claim 1 further including means for connecting said body to an electric wireline, and wherein said first explosive means includes a detonator that is adapted to be fired by an electrical signal on said wireline.

10. The apparatus of claim 1 further including means for connecting said body to a string of pipe by which it is lowered into the well bore; and firing pin means mounted adjacent said upper chamber, said first explosive means including a detonator that is adapted to be fired in response to the impact of a weighted object that is dropped from the surface through the pipe and onto said firing pin means.

11. Apparatus for use in preventing the firing of an explosive well tool until said well tool has been lowered to or below a predetermined depth in a fluid-filled well bore, comprising: a generally tubular body having threaded connection means at its upper and lower ends, said body defining upper and lower chambers, passage means for communicating adjacent ends of said chambers, and a transverse bore intersecting said passage means; piston means slidably arranged in said bore for movement between an outer position and an inner position, said piston means having an outer face that is subject to the hydrostatic pressure in the well bore, said piston means having an inner section that extends across said passage means in said outer position and an opening that is substantially aligned with said passage means in said inner position; spring means for yieldably resisting movement of said piston means toward said inner position; first explosive means mounted in said upper chamber; and second explosive means mounted in said lower chamber and arranged to be exploded in response to pressure forces generated by detonation of said first explosive means, said explosive forces being blocked from reaching said second explosive means until said opening in said piston means is substantially aligned with said passage means.

12. The apparatus of claim 11 wherein said spring means includes a cantilevered leaf spring having one end portion attached to said body and its other end portion slidably connected to said outer face of said piston means.

13. The apparatus of claim 12 further including means on said other portion and said outer face for maintaining the rotational orientation of said piston member in said transverse bore.

14. The apparatus of claim 13 further including recess means in said body for allowing inward flexure of said other end portion as said piston means shifts toward said inner position.

15. The apparatus of claim 14 further including means on said body adjacent said recess means for providing a fulcrum point for said inward flexure.

16. The apparatus of claim 12 wherein said spring means further includes nested coil springs reacting between said body and an inner end surface of said piston means.

* * * * *